US005330112A

United States Patent [19]

Nagaoka et al.

[11] Patent Number: 5,330,112

[45] Date of Patent: Jul. 19, 1994

[54] CRUSHING APPARATUS

[75] Inventors: Osamu Nagaoka; Tsuyoshi Ishikawa, both of Tochigi, Japan

[73] Assignee: Mitsui Mining Company, Limited, Tokyo, Japan

[21] Appl. No.: 61,590

[22] Filed: May 17, 1993

[30] Foreign Application Priority Data

May 27, 1992 [JP] Japan ..... 4-35372[U]

[51] Int. Cl.[5] ..... B02C 17/16; B02C 23/30

[52] U.S. Cl. ..... 241/57; 241/79.1; 241/172

[58] Field of Search ..... 241/47, 79.1, 172, 173, 241/57

[56] References Cited

U.S. PATENT DOCUMENTS

| | | | |
|---|---|---|---|
| 4,505,918 | 3/1985 | Selles et al. | 241/39 |
| 4,534,516 | 8/1985 | Hashizume | 241/171 |
| 4,660,776 | 4/1987 | Ikebucht et al. | 241/53 |
| 4,673,134 | 6/1987 | Barthelmess | 241/57 |
| 5,167,375 | 12/1992 | Datta | 241/46.02 |
| 5,199,656 | 4/1993 | Szegvari et al. | 241/171 |

*Primary Examiner*—Mark Rosenbaum

*Assistant Examiner*—John M. Husar

*Attorney, Agent, or Firm*—Oliff & Berridge

[57] ABSTRACT

The material supplied to the interior of the crushing tank by the material supply device is: crushed into the form of a fine powder by the agitator; sent upward by a gas to be directed to the classifier through the guide device; classified in the course to the classifier and the fine powder reduced to a predetermined particle size is extracted to the outside by means of the fine powder discharge tube. On the other hand, the coarse powder of which the particle size has not been reduced to the predetermined particle size is guided again to the crushing tank through a ring-like circulation passage formed between the inner peripheral surface of the communicating portion of the classifier and the outer peripheral surface of the dispersing tube of the guide device so as to be crushed by the agitator. Since this process is repeated, a fine powder of the predetermined particle size is obtained. Further, since the process as described is performed by means of a continuous flow which flows through the interior of the crushing tank, the guide device and the classifier, aggregation and/or adhering of the fine powder may be prevented.

10 Claims, 3 Drawing Sheets

CRUSHING APPARATUS

BACKGROUND OF THE INVENTION

1. Field of the Invention

This invention relates to crushing apparatus and, more particularly, relates to a crushing apparatus capable of agitating to crush a material which has been introduced into a crushing tank to obtain a product in the form of a fine powder.

2. Description of the Related Art

In general, there is a type of crushing apparatus in which a material is introduced into a crushing tank and an agitator is then rotated to crush the material into pulverized particles in the form of a fine powder. Some of this type contain media in the crushing tank so that the material introduced into the crushing tank is to be crushed while it is agitated together with the media.

Such media-agitation type crushing apparatus crushes up the material by means of shearing force and impact force which are generated at the time of agitation, where its crushing ability is several tens of times greater than that of a ball mill.

However, while having a high crushing ability, the crushing efficiency of the crushing apparatus as described is relatively low.

Specifically, when the material is crushed up into pulverized particles in the form of a fine powder especially in a dry crushing apparatus, the pulverized particles in the form of a fine powder may be aggregated within the crushing tank to equilibrate the crushing process.

The pulverized particles in the form of a fine powder have a strong tendency to aggregate. As a result, the material once crushed into the form of a fine powder is aggregated to be increased in particle size again, even though it is in the process of agitation/crushing by means of the media.

Accordingly, when crushing action and aggregating action are repeated within the crushing tank, the crushing process is brought into an equilibrium to halt the progress of crushing even if a larger amount of energy for crushing is supplied. The obtainable particle size of the pulverized particles as a product is limited, resulting in a lower crushing efficiency.

Further, some crushing apparatus have a built-in classifier for improving accuracy in the fineness of the product.

A classifier having a high-speed rotor is usually used as the classifier incorporated into such crushing apparatus. Since the material crushed into the form of a fine powder tends to cause clogging at the rotating portion of the rotor, an obstacle on the rotation of the rotor may result to lower the classifying efficiency.

Further, re-aggregation of the material tends to occur to cause a lowered classifying efficiency. In addition, thus aggregated fine powder is returned to the interior of the crushing tank, resulting in a problem that the crushing efficiency may be reduced.

SUMMARY OF THE INVENTION

Accordingly, it is a first object of this invention to provide a crushing apparatus capable of preventing an increase in particle size due to re-aggregation of finely crushed material in the crushing tank thereof so as to improve crushing efficiency and energy efficiency.

It is a second object of this invention to provide a crushing apparatus capable of preventing the crushed material from an excessively long residence time within the crushing chamber by quickly discharging it to the outside thereof, so as to prevent it from being excessively crushed and re-aggregated within the crushing tank.

It is a third object of this invention to provide a crushing apparatus in which classification based on air current is possible without a rotor in the classifier thereof and thus the material crushed into the form of a fine powder does not adhere to the classifier.

These and other objects, features and advantages of this invention will become clear from following description of the preferred embodiment when the same is read in conjunction with the accompanying drawings.

BRIEF DESCRIPTION OF THE DRAWINGS

FIG. 1~FIG. 3 illustrate an embodiment of a crushing apparatus according to this invention, in which:

FIG. 1 is a schematic longitudinal sectional view showing the overall construction of the same;

FIG. 2 is a schematic longitudinal sectional view showing certain portions of the same; and FIG. 3 schematically illustrates the relation between the guide device and the classifier.

DESCRIPTION OF PREFERRED EMBODIMENT

Figure 1:
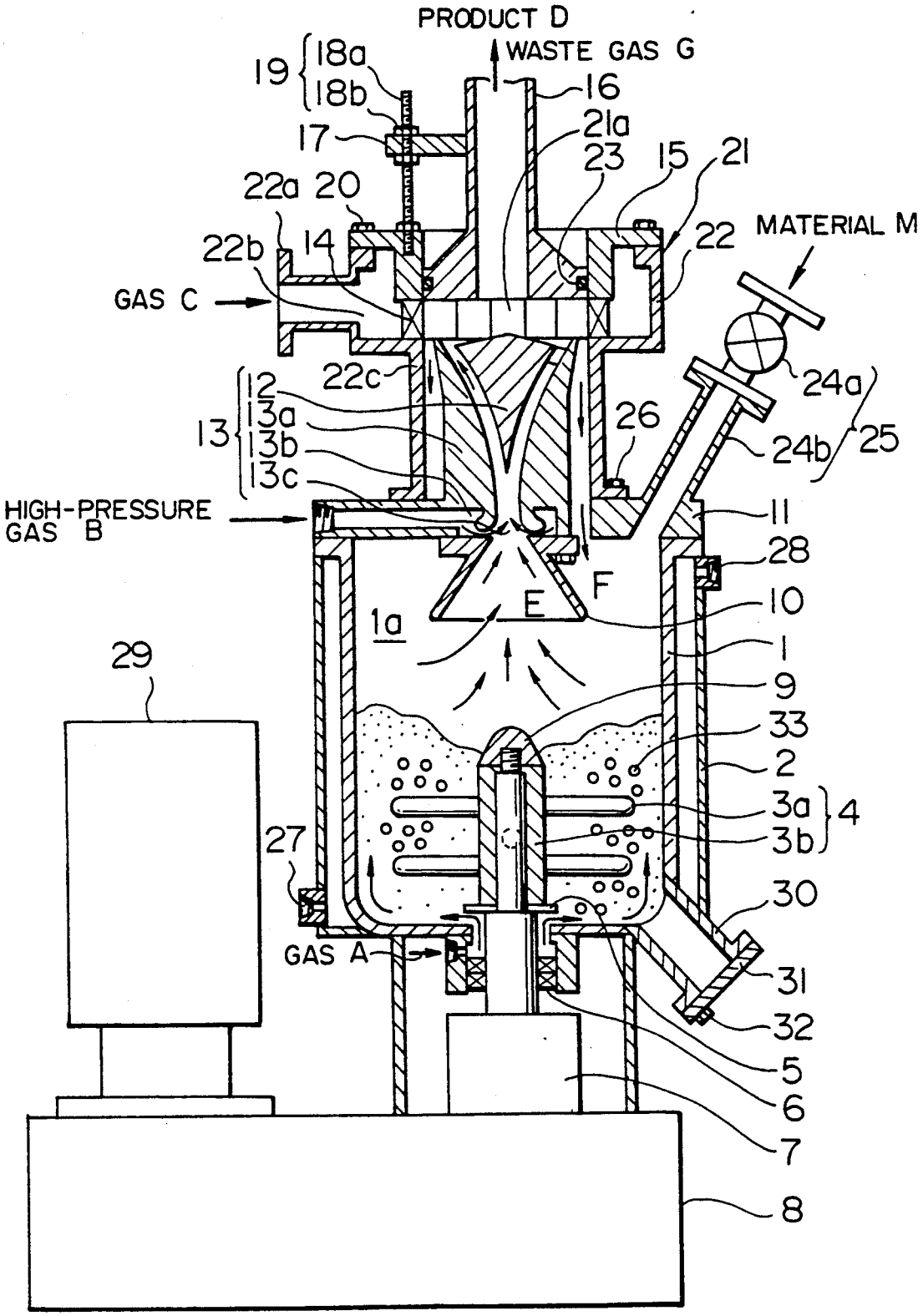
Figure 2:
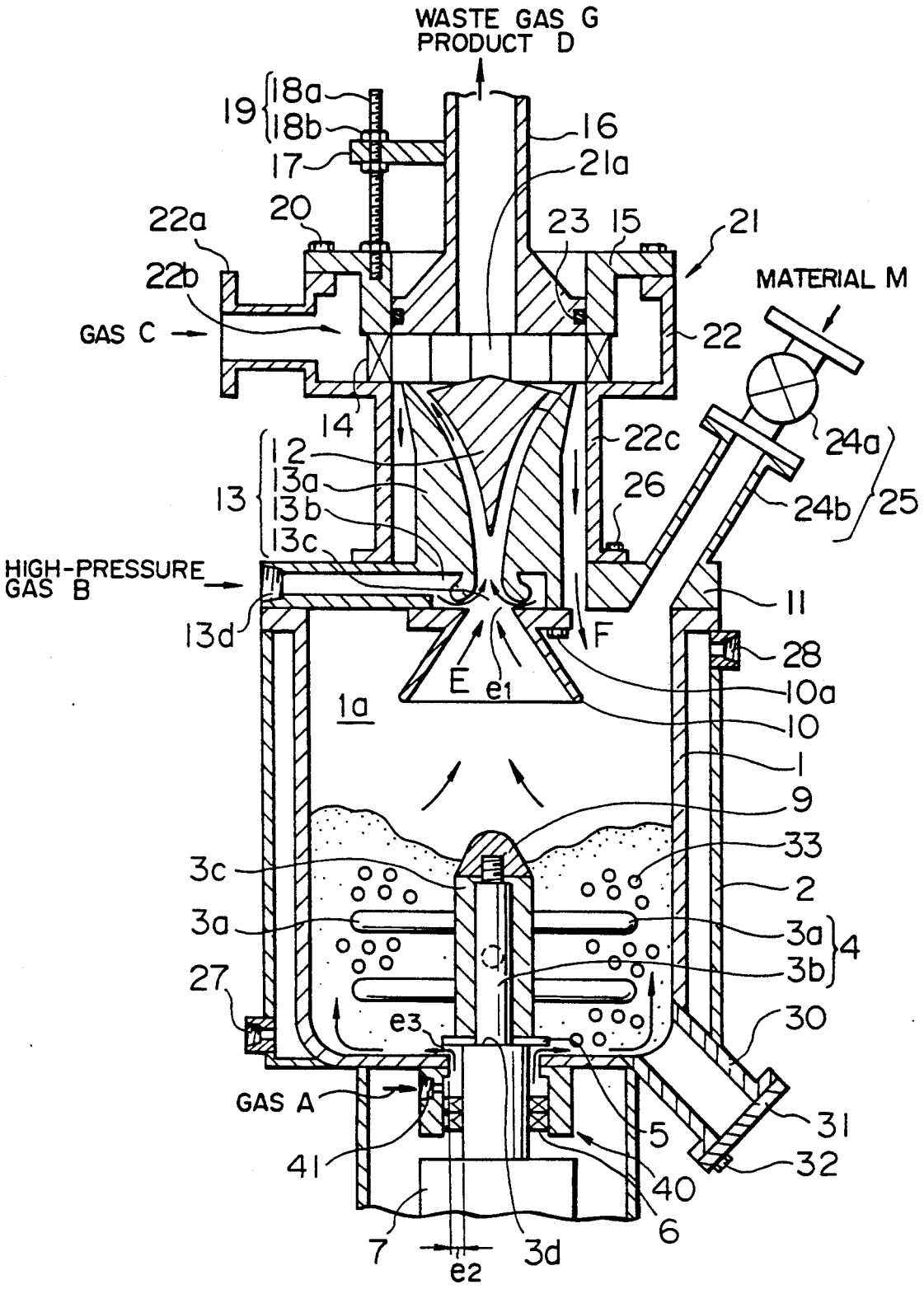

A crushing apparatus according to this invention comprises: a frame 8; a crushing tank 1 positioned on the upper portion of the frame 8 in the form of a cylinder opened upward and having an agitator 4 provided thereon for crushing a material M into the form of a fine powder; a classifier 21 of a substantially cylindrical shape provided at the upper portion of the crushing tank 1 and having a classifying chamber at the interior thereof; a guide device 13 for guiding a fine powder of the material M generated in the crushing tank 1 to the classifying chamber of the classifier 21; and a fine powder extracting tube 16 communicated with the classifying chamber of the classifier 21.

The material M introduced into the crushing tank 1 is guided by the guide device 13 to the classifier 21 to be classified after being crushed into the form of a fine powder and is then discharged to the outside from the fine powder extracting tube 16.

The classifier 21 includes: a gas guide chamber **22*b* into which a gas C is introduced from the outside; a gas emitting portion 22 for emitting the gas C in the gas guide chamber to the classifying chamber; a vane 14 for guiding the gas C emitted from the gas emitting portion 22 to the tangential direction of the classifier 21; and a cylindrical communicating portion 22*c* for providing a guide to the crushing tank 1**.

The guide device 13 includes: a dispersing tube **13*a* having a cavity gradually increased in diameter and having openings at the two ends thereof; an introduction port 13*c* formed at the smaller diameter opening of the dispersing tube 13*a*; and a gas reservoir 13*b* for supplying a high-pressure gas B to the introduction port 13*c***.

By providing the guide device 13 at the interior of the communicating portion **22*c* of the classifier 21, a circulation passage communicating the classifying chamber with the crushing tank 1 is formed between the guide device 13 and the communicating portion 22*c***.

A gas supply device 40 for supplying a gas A into the crushing tank 1 is provided at the bottom portion of the crushing tank 1.

The crushing tank 1 is formed into a vertically disposed cylinder having a crushing chamber 1*a* opened upward and is provided at the upper portion of the frame 8.

The agitator 4 rotatable by a driving force is provided in the crushing chamber 1*a* of the crushing tank 1 so that the material M supplied into the crushing tank 1 is crushed into the form of a fine powder by the rotation of the agitator 4.

The agitator 4 is formed by a rotating shaft 3*b* and arm 3*a*.

The rotating shaft 3*b* penetrates through a hole provided at the center portion of the bottom surface of the crushing tank 1 and is rotatably supported thereat, and a circular gap e2 is formed between the crushing tank 1 and the rotating shaft 3*b* so that the interior and the exterior of the crushing tank 1 are in communication with each other through the gap e2.

The rotating shaft 3*b* is rotatably supported at the lower portion thereof on the frame 8 by a baring portion 7.

Arms 3*a* are attached to the portion of the rotating shaft 3*b* which is within the crushing chamber 1*a*. The arms 3*a* are each provided in the form of a rod or a wing and are attached radially and in a plurality of stages to the outer peripheral surface of a cylindrical arm attaching portion 3*c*.

The arm attaching portion 3*c* to which the arm 3*a* is attached is placed upon the rotating shaft 3*b* and, then, a holding nut 9 is screwed onto a terminal end portion of the rotating shaft 3*b* to integrally fix the arm attaching portion 3*c* to the rotating shaft 3*b* together with the arm 3*a*.

A seal member 5 is attached to a stepped portion 3*d* of the rotating shaft 3*b* which is positioned within the crushing chamber 1*a* of the crushing tank 1. The seal member 5 is of the size incapable of being inserted into the hole formed on the bottom of the crushing tank 1 and is fixed in the manner sandwiched between the arm attaching portion 3*c* and the stepped portion 3*d*. The lower end surface of the seal member 5 faces the ring-like gap e2.

A ring-like gap e3 is formed between the end surface of the seal member 5 and the bottom surface of the crushing tank 1 that are opposing each other, the interior of the crushing tank 1 being in communication with the exterior thereof through the gap e3 and the gap e2.

A pulley (not shown) is disposed at the lower end portion of the rotating shaft 3*b*. The pulley is linked through a belt with a motor 29 which is the driving source, the rotating shaft 3*b* being rotated by the motor 29.

A gas supply device 40 is provided at the bottom of the crushing tank 1. The gas supply device 40 is formed into the shape of a cylinder and has the rotating shaft 3*b* of the agitator 4 disposed at the inside thereof. One of the openings of the gas supply device 40 is opened to the gap e2 formed at the hole on the bottom surface of the crushing tank 1, the interior of the gas supply device 40 being in communication with the crushing chamber 1*a* of the crushing tank 1 through the gaps e2, e3.

Provided on the other opening of the gas supply device 40 is an oil seal 6 for sealing the portion therefrom to the rotating shaft 3*b*, the interior of the gas supply device 40 being sealed by the oil seal 6.

The gas supply device 40 has a gas supply port 41, and a piping for introducing gas A from an external gas supply (not shown) is connected to the gas supply port 41 to introduce the gas A to the interior of the gas supply device 40.

The gas A is a shaft sealing gas provided for the rotating shaft 3*b*.

On the other hand, a plate-like lid 11 for closing the crushing chamber 1*a* is disposed at the upper surface opening of the crushing tank 1. The lid 11 has a material supply device 25 for introducing the material M into the crushing tank 1.

The material supply device 25 is formed by a material introducing nozzle 24*b* and a rotary valve 24*a*. The material introducing nozzle 24*b* is mounted on the lid 11 to provide communication between the crushing chamber 1*a* and the exterior thereof. The rotary valve 24*a* is mounted on the material introducing nozzle 24*b*, the material M being introduced to the rotary valve 24*a*.

The material M introduced from the outside is continually supplied to the crushing chamber 1*a* through the material introducing nozzle 24*b* by the rotation of the rotary valve 24*a*. The rotary valve 24*a* is usually in its sealed state to close the opening of the material introducing nozzle 24*b*.

The classifier 21 is provided at the upper portion of the lid 11. The classifier 21 is formed into a cylindrical shape and has a classifying chamber formed therein. The material M crushed into the form of a fine powder at the crushing chamber 1*a* of the crushing tank 1 is classified by the classifier 21 according to its size and weight. The classifier 21 is provided so that the axial line thereof coincides with the axial line of the crushing tank 1.

The gas emitting portion 22 is formed at the interior of the classifier 21. The gas emitting portion 22 is formed in the shape of a ring so as to surround the classifying chamber, and a ring-like gas guiding chamber 22*b* is formed on the outer peripheral side of the classifier 21 by the gas emitting portion 22.

Figure 3:
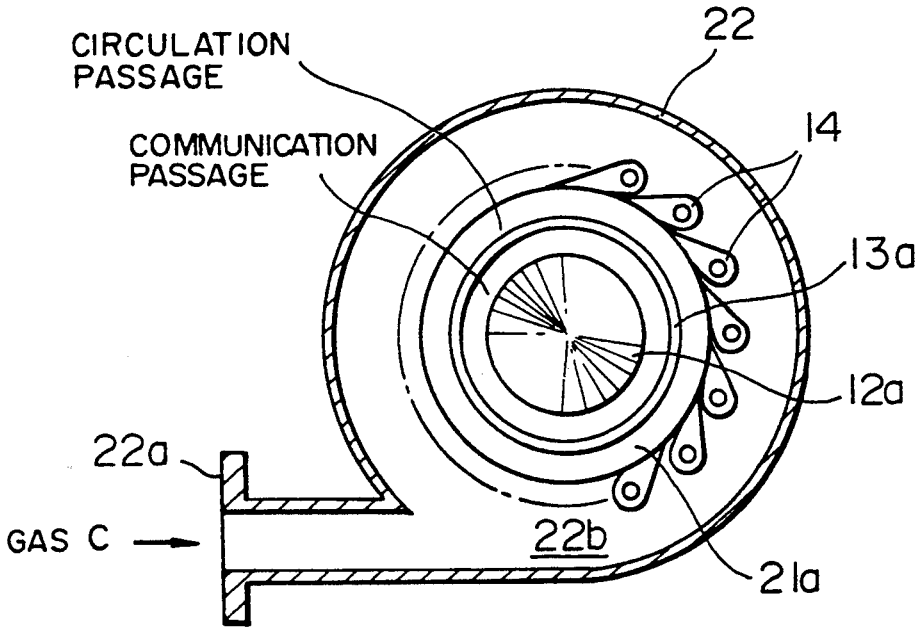

Further, the gas emitting portion 22 has a gas introducing port 22*a* formed on the outer peripheral surface thereof so that a gas C supplied from the outside is introduced into the gas guide chamber 22*b*. As also shown in FIG. 3, the gas introducing port 22*a* is connected to the gas emitting portion 22 in a tangential direction of the outer peripheral surface thereof.

A plurality of vanes 14 are disposed at the inner side opening of the gas emitting portion 22. The vanes 14 provide the division between the gas guide chamber 22*b* of the gas emitting portion 22 and the classifying chamber 21*a*. The gas C introduced to the gas guide chamber 22*b* from the outside is emitted to the classifying chamber 21*a* through the vanes 14.

The vanes 14 are disposed at the inner side opening of the gas emitting portion 22, equidistantly along the circumferential direction thereof in the manner oriented in a tangential direction of the classifier 21.

Thus, when passing the vanes 14, the gas C is guided so that it is directed in the axial direction at the interior of the classifier 21. Thereby, the orientation is determined of the gas C which is emitted into the classifying chamber 21*a* from the gas guide chamber 22*b*.

A communicating portion 22*c* for communication with the classifying chamber 21*a* is formed at the lower portion of the classifier 21. The communicating portion 22*c* is formed into a cylindrical shape and is positioned so as to be connected at the lower side opening thereof to the hole formed on the lid 11. The crushing chamber 1*a* of the crushing tank 1 and the classifying chamber of the classifier 21 are communicated with each other through the communicating portion 22c.

The guide device 13 having the dispersing tube 13a, the gas reservoir 13b and the introduction port 13c is provided at the interior of the communicating portion 22c of the classifier 21.

The dispersing tube 13a is provided in the shape of a vertically oriented cylinder and has an inside cavity of which the diameter is gradually increased toward the top thereof. It is formed so that its inner wall is smoothly curved and it has a smaller diameter opening formed at the lower end thereof and a larger diameter opening formed at the upper end thereof.

The introduction port 13c extended outward in a curved manner is formed at the smaller diameter opening of the above described dispersing tube 13a. The dispersing tube 13a is positioned at the interior of the communicating portion 22c of the classifier 21 such that the introduction port 13 is in communication with the crushing chamber through a hole formed at the center portion of the lid 11.

The ring-like gas reservoir is formed around the introduction port 13c, the gas reservoir 13b and the introduction port 13c being in communication with each other through a small gap.

A gas opening 13d for communication with the outside is formed at a position on the outer peripheral surface of the gas reservoir 13b and piping to an external high-pressure gas supply (not shown) is connected to the gas opening 13d so that the high-pressure gas B is supplied to the gas reservoir 13b through the gas opening 13d.

Thus the high-pressure gas B supplied to the interior of the gas reservoir 13b is introduced to the introduction port 13c.

Further, the guide device 13 as described is provided at the interior of the communicating portion 22c of the classifier 21 in the state where its axial line coincides with the axial line of the classifier 21, so that the fine powder formed in the crushing chamber 1a of the crushing tank 1 is directed to the classifying chamber 21a of the classifier 21 by the guide device 13..

Since the guide device 13 is provided to have a predetermined separation from the inner wall of the communicating portion 22c of the classifier 21, a ring-like circulation passage for providing communication between the crushing chamber 1a of the crushing tank 1 and the classifying chamber 21a of the classifier 21 is formed between the outer peripheral surface 13a of the dispersing tube 13a of the guide device 13 and the inner peripheral surface of the communicating portion 22c of the classifier 21.

Further, a core 12 is provided within the dispersing tube 13a of the guide device 13 at the larger diameter opening side thereof.

This core 12 is formed into the shape of an inverted cone which has a curved surface corresponding to the inner wall of the dispersing tube 13a, thereby a ring-like communication passage of which the diameter is gradually increased upward is formed between the dispersing tube 13a and the core 12. Thus the fine powder passing through this portion is directed to the outer peripheral portion within the classifying chamber 21a.

A suction nozzle 10 is provided below the guide device 13. The suction nozzle 10 is formed into the shape of a trapezoidal cone, where the upper opening thereof faces the introduction port 13c of the guide device 13 such that a ring-like small gap el is formed therefrom to the introduction port 13c.

The suction nozzle 10 is fixed at a flange portion formed at the upper opening thereof to the lower portion of the guide device 13 so as to be positioned within the crushing chamber 1a of the crushing tank 1.

A fine powder extracting tube 16 is provided above the classifier 21 as described. The fine powder extracting tube 16 is disposed such that its opening is opened to the classifying chamber of the classifier 21 in the state where its axial line is caused to coincide with the axial line of the classifier 21. The classifying chamber 21a is in communication with the outside thereof through the fine powder extracting tube 16.

The fine powder extracting tube 16 is positioned at the inner side of a fixing member 15 which is rigidly fixed to the upper end portion of the classifier 21. Further, it is adapted to be movable in an up and down direction by a linking member 19 which is provided between the fixing member 15 and the fine powder extracting tube 16.

The linking member 19 is formed by bolt 18a and nuts 18b. The bolt 18a of the linking member 19 is rigidly fixed to the fixing member 15 and the nuts 18b rotatably attached to an attaching portion 17 formed on the fine powder extracting tube 16 are threaded onto the bolt 18a. When the nut 18b is rotated, the fine powder extracting tube 16 is moved up and down along the fixing member 15.

It should be noted that numeral 2 denotes a jacket which is provided to cover the outer side of the crushing tank 1 with a predetermined separation so as to form the communication passage of the medium between the crushing tank 1 and the jacket 2.

Formed on the jacket 2 are an introduction nozzle 27 for introducing a heat medium or a cooling medium and a discharging nozzle 28 for discharging the same.

Numeral 33 denotes the media which are dispersed in the crushing chamber 1a of the crushing tank 1 to agitate and crush the material M upon the rotation of the agitator 4.

Numerals 10a, 20, 26 denote bolts: the bolt 10a for fixing the suction nozzle 10 to the guide device 13; the bolt 20 for fixing the fixing member 15 to the classifier 21; and the bolt 26 for fixing the classifier 21 to the lid 11. Numeral 23 denotes a seal ring for providing a seal between the fine powder extracting tube 16 and the fixing member 15.

Numeral 30 denotes a ball extracting port which is provided to extract the media 33 to the outside. It is closed when the crushing apparatus is operated as a plug 31 is attached thereto by means of the bolt 32 so that the material M and/or the media 33 contained at the inside portion does not flow out.

The operation of what has been described above will now be described.

The material M to be crushed is supplied to the crushing chamber 1a of the crushing tank 1 from the material supplying device 25 and the motor 29 is started to rotate the agitator 4.

Then, the introduce material M is agitated together with the media 33 which has previously been contained in the crushing chamber 1a and is crushed into the form of a fine powder by means of impacting force and shearing force.

At the time of such crushing, since the gas supply device 40 provided at the bottom of the crushing tank 1 supplies the gas A into the crushing chamber 1a through the gaps e2, e3, the fine powder resulting from crushing of the material M is moved toward the top of the crushing chamber 1a and is directed to the suction nozzle 10 where the gas A acts as the carrier.

Since the crushing chamber 1a is in communication with the outside through the guide device 13, the classifier 21 and the fine powder extracting tube 16, supplying of the gas A to the interior of the crushing chamber 1a by the gas supply device 40 is continually performed.

The high-pressure gas B is supplied to the gas reservoir 13b of the guide device 13 and the high-pressure gas B is caused to flow into the interior of the dispersing tube 13a from the introduction port 13c through the gap e1.

Since the introduction port 13c is curved, the flowing high-pressure gas B at the time of its flowing into the introduction port 13c is formed into an attaching flow along the curve of the introduction port 13c to result a wall surface flow causing the so-called Coanda effect.

As a result, a negative pressure occurs at the axial portion of the dispersing tube 13a.

Accordingly, the fine powder occurring within the crushing chamber 1a is sucked into the dispersing tube 13a through the suction nozzle 10. At the same time, the gas E existing within the crushing chamber 1a is formed into a suction flow to be sucked into the dispersing tube 13a. Further, the fine powder is guided to the classifying chamber 21a of the classifier 21 by the communication passage formed between the dispersing tube 13a and the core 12.

The communication passage formed between the dispersing tube 13a and the core 12 is of a ring-like shape of which the diameter is gradually increased toward the top thereof. Thus the fine powder passing through this communication passage is guided to the vicinity of the inner wall of the classifying chamber 21a.

Here, since coarse grains which have not been reduced to a predetermined particle size are included in the fine powder guided to the classifying chamber by the communication passage, the fine powder is classified into a fine powder and a coarse powder by the classifier 21.

In the classifying chamber 21a, the gas emitting portion 22 emits the gas C toward the inside. Since the gas C is caused to flow in the tangential direction of the classifier 21 by the vane 14, a convolutional air current is generated in the classifying chamber along the wall surface thereof. A kind of centrifugal field is thereby formed in the classifying chamber.

Accordingly, upon receiving the centrifugal force, classification is made by separating/discriminating relatively smaller particles and lighter particles to the inner side as a fine powder and larger particles and heavier particles to the outer side as a coarse powder.

At this time, since the communication passage formed between the dispersing tube 13a and the core 12 is adapted to guide the fine powder to the vicinity of the wall surface of the classifying chamber 21a where the convolutional air current of the gas C produces the largest effect, a centrifugal force may be given to the fine powder to improve the classifying efficiency.

It should be noted that, while the fine powder introduced to the classifying chamber 21a is started to be spiraled by the action of the gas C along the inner wall of the classifying chamber 21a, because the gas C is continually emitted from the gas emitting portion 22, the fine powder is classified without being adhered to the inner wall of the classifying chamber 21a whereby the accuracy of classification is improved.

Then, the separated coarse powder falls downward as it loses kinetic energy while spiraling along the inner wall of the communicating portion 22c together with the flow of the gas F through the circulation passage formed between the guide device 13 and the communicating portion 22c of the classifier 21. It is thereby returned to the crushing chamber 1a of the crushing tank 1 to be subjected to the crushing process again.

At this time, the pressure of gas E which will result in the suction flow is set at a pressure greater than the pressure of gas A to be supplied to the crushing chamber 1a from the gas supply device 40. Thus the pressure of gas F which will result in the circulatory flow becomes (pressure of gas E)−(pressure of gas A) whereby flowing of gas F continues.

Further, the fine powder separated to the inner side in the classifying chamber flows into the fine powder extracting tube 16 and is extracted to the outside as product D together with the discharge gas G.

The discharge gas G is a mixed gas (G=A+B+C) consisting of: gas A supplied from the gas supply device 40; the high-pressure gas B flowing in from the gas reservoir 13b; and gas C to be emitted from the gas emitting portion 22 of the classifier 21, whereby gases A, B, C flow continuously.

In the above described crushing apparatus, since the classifier 21 is provided at the upper portion of the crushing tank 1, the fine powder resulting from crushing of the material M within the crushing chamber 1a of the crushing tank 1 is prevented from being aggregated within the crushing chamber 1a, crushing processing in the crushing chamber 1a may be efficiently performed.

That is, the material M crushed into the form of a fine powder in the crushing chamber 1a of the crushing tank 1 is guided to the classifying chamber 21a of the classifier 21 by the guide device 13 to be separated/discriminated into a fine powder and a coarse powder. Since, of these, the fine powder which has been reduced to a predetermined particle size is quickly extracted as product D from the fine powder extracting tube 16, the fine powder does not stay too long at the interior of the crushing chamber 1a.

Accordingly, the fine powder is prevented from being aggregated in the crushing chamber 1a of the crushing tank 1, whereby the crushing efficiency is improved.

At the same time, since the fine powder is quickly extracted to the outside, only a coarse powder which requires crushing remains in the crushing chamber 1a. As a result, the crushing speed may be increased to improve the crushing efficiency.

Further, since gas F is a continuous flow, the coarse powder separated at the classifying chamber 21a does not adhere to the inner wall of the communicating portion 22c and the outer wall of the dispersing tube 13a.

The circulating flow of gas F flows continually and joins gas A from the gas supply device 40 at the crushing chamber 1a to form gas E which results in the suction flow. Thus the circulating flow of gas F continually acts upon the fine powder occurring within the crushing chamber 1a. As a result, the fine powder is continuously caused to flow so as to be prevented from being adhered to the inner wall of the crushing chamber 1a or from remaining within the crushing chamber 1a.

In this manner, adhering respectively of coarse powder to the inner wall of the communicating portion 22c and to the outer wall of dispersing tube 13*a* and of fine powder to the inner wall of the crushing chamber 1*a* may be prevented by the circulating flow of gas F. In addition, residence of fine powder in the crushing chamber 1*a* may be prevented. Thereby, effective crushing processing for a long period of time becomes possible.

Further, in the above described crushing apparatus, classifying may be efficiently performed, since the fine powder produced in the crushing chamber 1*a* of the crushing tank 1 is subjected to dispersing when passing through the guide device 13 prior to classifying at the classifier 21.

In other words, the guide device 13 has at the interior of the dispersing tube 13*a* a cavity of which the diameter is gradually increased upward. In addition, the open end portion of the introduction port 13*c* formed at the smaller diameter opening of the dispersing tube 13*a* is curved and extended outward. Thus, when the high-pressure gas B flows into the introduction port 13*c* from the gas reservoir 13*b*, a high-speed air current occurs at the interior of the dispersing tube 13*a*.

That is, the guide device 13 has a smaller diameter portion of which the diameter is smoothly reduced, in the course from the open end portion of the introduction port 13*c* thereof to the larger diameter open end portion of the dispersing tube 13*a*. Thus, when the high-pressure gas B flows thereinto from the gas reservoir 13*b*, a large negative pressure due to the Coanda effect results around the axial line portion within the dispersing tube 13*a*.

Accordingly, due to the action of this large negative pressure, the fine powder and gas E to be sucked from the crushing chamber 1*a* through the suction nozzle 10 form a high-speed flow and flows the communication passage between the dispersing tube 13*a* and the core 12. The fine powder is dispersed by a strong force due to the difference in speed between gas E and the attaching flow along the inner wall of the dispersing tube 13*a*.

Further, in the above described case, separateness of the particles from each other in the fine powder is most important to efficiently classify the fine powder at the classifying chamber 21*a* of the classifier 21. While efficient classifying is impossible if this is inadequate, dispersing effect due to the Coanda effect is caused in the guide device 13 whereby the particles constituting the fine powder may be securely dispersed to previously separate them from each other. Classifying at the classifying chamber 21*a* may be performed securely and efficiently.

Further, in this case, the suction nozzle 10 is provided in a manner facing the introduction port 13*c* at its smaller diameter opening and with a small separation therefrom. Thus gas E passes through the smaller diameter opening of the suction nozzle 10 at a high speed. Since gas E is further increased in its speed at the introduction port 13*c* when it is sucked, the efficiency of dispersing is further improved.

Further, in this crushing apparatus, change in the classifying point of the classifier 21 may be easily performed from the outside.

Specifically, the classifying point is determined by up and down positioning of the fine powder extracting tube 16 which sets the upper limit of the classifying chamber 21*a* of the classifier 21. The fine powder extracting tube 16 is disposed on the classifier 21 in a manner movable in the up and down direction by the linking member 19.

Accordingly, by making variable the up and down position of the fine powder extracting tube 16, the distance between the opposing surfaces of the core 12 of the guide device 13 and the fine powder extracting tube 16, i.e., the width of the classifying chamber may be determined at will. As a result, setting of the extent of classification, i.e., the particle size of the product D may be easily changed.

It should be noted that, when the classifying point is set to a relatively upper position by moving the fine powder extracting tube 16 upward, the distance between the opposing surfaces of the fine powder extracting tube 16 and the core 12 is increased to make slower the flowing-in speed of the fine powder to the fine powder extracting tube 16. Thus the product D may be obtained, which is constituted by relatively smaller and lighter particles.

On the other hand, when the classifying point is set to a lower position by moving the fine powder extracting tube 16 downward, the distance between the opposing surfaces of the fine powder extracting tube 16 and the core 12 becomes smaller. Since the speed at which the fine powder flows into the fine powder extracting tube 16 is increased, the product D constituted by a fine powder containing relatively heavier particles may be obtained.

Further, in changing the extent of classification, in addition to the above described means, such methods as changing the emitting speed of gas C by adjusting the extent of opening at the vane 14 provided at the opening of the gas emitting portion 22 of the classifier 21 or changing the amount of gas C to be introduced from the gas introduction port 21*a*. Either of these methods may be used.

Therefore, according to this invention, the guide device for directing to the classifying chamber of a classifier the fine powder which has been produced by crushing the material in the crushing chamber of the crushing tank is formed by: a dispersing tube having a cavity formed therein and gradually increased in diameter toward one end thereof; an introduction port provided at the smaller diameter opening of the dispersing tube in a manner extended outward; and a gas reservoir for supplying a high-pressure gas to the introduction port. Thus, it is possible to produce an effect for dispersing the fine powder at the interior of the dispersing tube by the Coanda effect when the fine powder passes through the guide device.

Thus, the fine powder is fully dispersed at the interior of the guide device before reaching the classifying chamber, classifying processing in the classifying chamber thereafter may be performed efficiently and accurately.

In addition, a core is provided at the interior of the dispersing tube of the guide device to form a communication passage of the fine powder between the dispersing tube and the core so as to direct the fine powder through the communication passage to the field of centrifugal force which is formed by the air current of a gas emitted from a gas emitting portion. Thus, centrifugal force for classification may be given to all the particles constituting the fine powder. As a result, a product which is accurate in fineness may be obtained without unevenness.

Further, in the classifying chamber, those particles reduced to a predetermined particle size are separated from the fine powder and are sequentially extracted to the outside from the fine powder extracting tube. Thus, an unnecessarily long residence time of the fine powder may be prevented, thereby preventing aggregation of the fine powder within the crushing chamber. Accordingly, the crushing processing in the crushing chamber is quickly performed, whereby the energy efficiency may be improved and the crushing efficiency may be improved.

Further, a circulating flow of a gas is caused to continually flow through the circulation passage for communicating the classifying chamber and the crushing chamber. Adhering of the fine powder within the classifying device and the crushing tank may be prevented and, thereby, a stable operation for a long time period is possible.

Further, since no rotating portion is in the classifier, such disadvantages as abrasion due to adhering of the fine powder do not occur, improving the reliability thereof.

Further, the fine powder extracting tube is disposed in a manner movable by the linking member in the up and down direction with respect to the classifying device. Thus, the classifying point may be easily changed by the operation of the linking member. As a result, the extent of classification (particle size of the product) may be easily changed.

What is claimed is:

1. A crushing apparatus for crushing a supplied material into the form of a fine powder and for guiding the fine powder to the outside thereof, said crushing apparatus comprising:

a crushing tank having a crushing chamber opened upward and having an agitator provided therein to crush the supplied material into the fine powder;

a classifier provided adjacently to the upper portion of said crushing tank and formed into substantially a cylindrical shape containing a classifying chamber, said classifier having: a gas emitting portion for emitting a gas to said classifying chamber; a vane for guiding the gas from the gas emitting portion in the tangential direction thereof; and a cylindrical communicating portion for communicating said classifying chamber with said crushing chamber of said crushing tank; and a guide device disposed at the interior of the communicating portion of said classifier for guiding the fine powder formed within said crushing chamber to the classifying chamber of said classifier and forming a ring-like circulation passage between said guide device and the inner surface of the communicating portion of said classifier, said guide device having: a dispersing tube having a cavity formed therein and gradually increased in diameter toward said classifying chamber; an introduction port provided at an opening on the crushing chamber side of the dispersing tube; and a gas reservoir for supplying a high-pressure gas to the introduction port; and a fine powder extracting tube for directing to the outside thereof the fine powder classified at the classifying chamber of said classifier.

2. A crushing apparatus according to claim 1, wherein a gas supply device for supplying a gas to said crushing chamber from an external source thereof is provided at the bottom of said crushing tank.

3. A crushing apparatus according to claim 1, wherein a material supply device for supplying the material to said crushing chamber from an external source thereof is provided at the upper portion of said crushing tank.

4. A crushing chamber according to claim 1, wherein a core is provided at the interior of the cavity of the dispersing tube of said guide device in a manner spaced therefrom and a ring-like communication passage gradually increased in diameter toward said classifying chamber is formed between the inner peripheral surface of the cavity of said dispersing tube and the outer peripheral surface of the core.

5. A crushing apparatus according to claim 1, wherein a suction nozzle increased in its diameter toward the lower end thereof is provided at the introduction port of said guide device with a small separation therefrom.

6. A crushing apparatus according to claim 1, wherein said fine powder extracting tube is attached in a manner movable in an up and down direction to said classifier through a linking member in the state where the opening of said fine powder extracting tube is positioned at the center portion of the classifying chamber of said classifier.

7. A crushing apparatus for crushing a supplied material into the form of a fine powder and for guiding the fine powder to the outside thereof, said crushing apparatus comprising:

a crushing tank having a crushing chamber opened upward, having an agitator provided therein to crush the material supplied through a material supply device into the fine powder and having a first gas supply device for sending the fine powder upward;

a classifier provided adjacently to the upper portion of said crushing tank and formed into substantially a cylindrical shape containing a classifying chamber, said classifier having: a gas emitting portion for emitting a second gas to said classifying chamber; a vane for guiding the second gas from the gas emitting portion in the tangential direction thereof; and a cylindrical communicating portion for communicating said classifying chamber with said crushing chamber of said crushing tank;

a guide device disposed at the interior of the communicating portion of said classifier for guiding the fine powder formed within said crushing chamber to the classifying chamber of said classifier and forming a ring-like circulation passage between said guide device and the inner surface of the communicating portion of said classifier, said guide device having: a dispersing tube having a cavity formed therein and gradually increased in diameter toward said classifying chamber; an introduction port provided at an opening on the crushing chamber side of the dispersing tube; and a gas reservoir for supplying a high-pressure gas to the introduction port; and a fine powder extracting tube attached movable in an up and down direction with respect to said classifier by means of a linking member in the state where an opening thereof is positioned at the center portion of the classifying chamber, said fine powder extracting tube for directing to the outside the fine powder classified at the classifying chamber of said classifier.

8. A crushing chamber according to claim 7, wherein a core is provided at the interior of the cavity of the dispersing tube of said guide device in a manner spaced therefrom and a ring-like communication passage gradually increased in diameter toward said classifying chamber is formed between the inner peripheral surface of said dispersing tube and the outer peripheral surface of the core.

9. A crushing apparatus according to claim 7, wherein a suction nozzle increased in its diameter toward the lower end thereof is provided at the introduction port of said guide device with a small separation therefrom.

10. A crushing apparatus for crushing a supplied material into the form of a fine powder and for guiding the fine powder to the outside thereof, said crushing apparatus comprising:

a crushing tank having a crushing chamber opened upward, having an agitator provided therein to crush the material supplied through a material supply device into the fine powder and having a first gas supply device for sending the fine powder upward;

a classifier provided adjacently to the upper portion of said crushing tank and formed into substantially a cylindrical shape containing a classifying chamber, said classifier having: a gas emitting portion for emitting a second gas to said classifying chamber; a vane for guiding the second gas from the gas emitting portion in the tangential direction thereof; and a cylindrical communicating portion for communicating said classifying chamber with said crushing chamber of said crushing tank;

a guide device disposed at the interior of the communicating portion of said classifier for guiding the fine powder formed within said crushing chamber to the classifying chamber of said classifier and forming a ring-like circulation passage between said guide device and the inner surface of the communicating portion of said classifier, said guide device having: a dispersing tube having a cavity formed therein and gradually increased in diameter toward said classifying chamber; an introduction port provided at an opening on the crushing chamber side of the dispersing tube; and a gas reservoir for supplying a high-pressure gas to the introduction port;

a fine powder extracting tube attached movable in an up and down direction with respect to said classifier by means of a linking member in the state where an opening thereof is positioned at the center portion of the classifying chamber, said fine powder extracting tube for guiding to the outside the fine powder classified at the classifying chamber of said classifier;

a suction nozzle provided on said crushing tank in the state where an upper opening of said suction nozzle is separated by a small distance from the introduction port of said guide device, said suction nozzle increased in diameter toward the lower end thereof; and a core provided at the interior of the cavity of the dispersing tube of said guide device in a manner spaced therefrom, said core forming a ring-like communication passage gradually increased in diameter toward said classifying chamber between the inner peripheral surface of said dispersing tube and said core.

* * * * *